US005248052A

United States Patent [19]

Mellinger et al.

[11] Patent Number: 5,248,052

[45] Date of Patent: Sep. 28, 1993

[54] APPARATUS FOR AUTOMATICALLY RELEASING THE SUPER-ATMOSPHERIC PRESSURE OF AN ENGINE COOLING SYSTEM IN RESPONSE TO TURNING OFF THE ENGINE AND PREVENTING THE BUILDUP OF PRESSURE WHILE THE ENGINE IS OFF

[76] Inventors: Larry L. Mellinger, 400 Hillcrest Cir.; Larry J. Henry, 16100 Height St., both of Belton, Mo. 64102

[21] Appl. No.: 922,872

[22] Filed: Jul. 31, 1992

[51] Int. Cl.[5] ..... B65D 51/16

[52] U.S. Cl. ..... 220/202; 220/203; 220/DIG. 32; 123/41.54

[58] Field of Search ..... 220/202, 203, 206, 231, 220/303, DIG. 32, DIG. 33; 123/41.54; 141/65, 192; 236/92 R, 92 C

[56] References Cited

U.S. PATENT DOCUMENTS

| | | | |
|---|---|---|---|
| 2,591,562 | 4/1952 | Levell | 220/231 |
| 3,062,400 | 11/1962 | Humbert | 220/203 |
| 3,587,912 | 6/1971 | Nagoya et al. | 220/231 |
| 4,079,855 | 3/1978 | Avrea | 220/203 |
| 4,185,751 | 1/1980 | Moore et al. | 220/203 |
| 4,196,822 | 4/1980 | Avrea | 220/203 |
| 4,484,541 | 11/1984 | Yokoyama | 123/41.1 |
| 4,744,356 | 5/1988 | Miller | 123/41.1 |

*Primary Examiner*—Allan N. Shoap

*Assistant Examiner*—Nova Stucker

*Attorney, Agent, or Firm*—Kenneth W. Iles

[57] ABSTRACT

An apparatus for releasing superatmospheric pressure in an engine cooling system when the engine is turned off and maintaining the cooling system at atmospheric pressure whenever the engine is not running is disclosed. The apparatus comprises a radiator cap having an over pressure valve for releasing excess pressure during engine operation and a suction return valve, or coolant recovery valve, for allowing coolant in a coolant recovery tank to be returned to the radiator and cooling system by a vacuum condition within the cooling system. The apparatus further comprises a push rod that penetrates the top of the radiator cap and reciprocates within a vertical sleeve seated in the center of the top of the radiator cap to open the suction return valve when the engine is not running, that is, the push rod is in the down position, and moves into an up position to allow the suction return valve to close, when the engine is running. In the preferred embodiment, the push rod is controlled by a vacuum motor, which operates on the ordinary engine vacuum, in a housing on top of the radiator cap. In an alternative embodiment, the push rod is controlled by an electrical solenoid that is energized whenever the engine is running, and is de-energized when the engine is not running. The push rod itself operates in the same fashion in either embodiment.

18 Claims, 4 Drawing Sheets

APPARATUS FOR AUTOMATICALLY RELEASING THE SUPER-ATMOSPHERIC PRESSURE OF AN ENGINE COOLING SYSTEM IN RESPONSE TO TURNING OFF THE ENGINE AND PREVENTING THE BUILDUP OF PRESSURE WHILE THE ENGINE IS OFF

BACKGROUND OF THE INVENTION

1. Field of the Invention

The present invention is related to an apparatus for automatically releasing the pressure in a pressurized liquid cooling system of an engine when the engine is turned off. More particularly, the present invention is directed to an apparatus comprising a radiator cap having an automatic mechanism for opening the suction return valve in the radiator cap to release cooling system pressure when the engine is turned off and leaving it open until the engine is restarted, utilizing either a vacuum motor or electrical solenoid and pin.

2. Description of Related Art

Engine cooling system components, such as hoses, wear out sooner than they should because they are subjected to superatmospheric pressure when such pressure is not required for engine cooling, that is, after the engine has been turned off. Engine cooling systems operate at superatmospheric pressure to increase the cooling capacity of the coolant and to increase engine efficiency. The engine water jacket, radiator, heater core and the like are typically connected together by a plurality of rubber hoses. Engine passageways are sealed from one another by gaskets. A head gasket, for example, seals the cylinders from the water jacket. These components deteriorate and fail from exposure to heat and pressure. While a certain amount of cooling system pressure may be desirable for proper engine cooling when the engine is running, that pressure is relieved only over the course of 1–5 hours after the engine is turned off, that is, as the engine cools enough to allow the cooling system pressure to fall to atmospheric pressure. The service life of the hoses and similar components would be significantly increased if there was no pressure on them when the engine was not running. Indeed, for many short trips, significant superatmospheric pressure will be exerted on the cooling system for several times as long as the trip actually takes. It is expected that the present invention will extend the life of radiator and heater hoses by at least 25%–30% and will similarly reduce the incidence of costly radiator leaks, depending on vehicle use characteristics.

A second problem is perhaps more serious, as it is safety related. Every year many motor vehicle operators and mechanics are scalded when they open a pressurized radiator. The resulting injuries may be quite serious and require extended and expensive medical care, including plastic surgery. Many devices have been designed that supposedly allow a hot radiator to be opened safely. These devices, however, seem primarily to be in the nature of shields that are intended to prevent the hot cooling fluid from reaching the operator. Moreover, hardly anyone owns such a device. Most people who need access to the cooling system when the engine is hot simply wait, but frequently do not wait long enough for the cooling of the engine to relieve the cooling system pressure. Many accidental injuries could be prevented by a device that automatically releases all superatmospheric pressure on a vehicle cooling system when the engine is not running.

The prior art related references demonstrate that significant effort has been directed to radiator caps for so called closed cooling systems, that is, a cooling system in which coolant that escapes, either through thermal expansion or evaporation, is collected in a coolant recovery tank, where it cools and where vapors condense into liquid, and which is returned to the radiator and cooling system when the engine cools. The references discussed herein, however, do not disclose or suggest any radiator cap or other device that automatically releases the superatmospheric pressure on the cooling system whenever the engine is turned off, which appears to be the only sure and certain way of solving the two problems discussed above. Some of these related art references are discussed below.

A typical prior art radiator cap of the provides access to and protection for the cooling systems of liquid cooled engines, especially the cooling system of vehicle engines, which typically include a water jacket surrounding the cylinders of the engine, a radiator for dissipating excess heat from the engine, and a plurality of rubber hoses for circulating the coolant from the engine into the radiator and back into the engine water jacket. The cooling system also includes other equipment, typically a thermostat for controlling the temperature of the coolant, a heater core and connecting hoses, a heater switch for regulating the flow of coolant through the heater core, and so forth. The prior art radiator cap is designed to permit a predetermined amount of pressure, for example, 15 pounds per square inch (psi), to develop within the cooling system to increase the boiling point, and hence the heat carrying capacity of the coolant. Too much pressure, however, can rupture a hose or other elements of the cooling system, so the radiator cap includes an over pressure release valve designed to open automatically when pressure in the cooling system exceeds the predetermined maximum pressure, thereby venting the excess pressure. A spring on the over pressure release valve closes the valve again when the pressure is reduced below the allowable maximum.

A certain amount of atmospheric gases, for example, nitrogen and oxygen, are typically dissolved in the cooling fluid and these gases boil out of the coolant when it is heated. In addition, a certain amount of water and antifreeze evaporates as the coolant is heated, so that there is always a certain amount of gas in the cooling system. This gas accumulates at the top of the cooling system, which is typically where the radiator cap is located.

In addition, the liquid coolant expands as it is heated. The coolant expands enough to overflow and escape from the radiator through the over pressure release valve. The lost coolant is recovered in a coolant recovery tank, which is connected to the radiator by an airtight hose.

As the engine cools, the volume of the coolant shrinks, eventually creating a partial vacuum in the cooling system. This partial vacuum opens a small valve in the bottom of the radiator cap, which we will call the "suction return valve," allowing the some of the coolant in the coolant recovery tank to be drawn into the radiator and cooling system. This cycle maintains a substantially full radiator and prevents loss of coolant. The prior art has devoted significant effort to developing radiator caps that control this cycle and prevent the cooling system from boiling over and allows the coolant to return to the radiator when the engine cools.

A preferred radiator cap for use in conjunction with the present invention is described and claimed in U.S. Pat. No. 4,185,751, issued to Moore et al. on Jan. 29, 1980 and entitled "Radiator Cap." This patent was assigned to Stant Manufacturing Company, Inc., in Connersville, Ind. at the time of issuance. This U.S. Pat. No. 4,185,751 is hereby incorporated by reference into this specification. Naturally, the present invention may be used in conjunction with any radiator cap having both an over pressure release valve and a suction return valve.

The present invention improves on such radiator caps by automatically opening the suction return valve, or coolant recovery valve, when the engine is turned off and keeping the suction return valve open whenever the engine is not running, thereby removing pressure from the system whenever the engine is turned off. Using the present invention, pressure within the cooling system will be entirely released within about 15–45 seconds after the engine is turned off, depending on specific operating parameters and then current conditions. Further, the present invention maintains the cooling system at atmospheric pressure, regardless of the temperature of the engine, at all times when the engine is turned off.

Other radiator caps of the related art have also been patented. Some of these caps are discussed below.

U.S. Pat. No. 4,196,822, issued to Avrea on Apr. 8, 1980 (Avrea '822), discloses a "Monolithic Radiator Cap for Sealed Pressurized Cooling System" comprising a radiator cap that remains sealed whenever it is seated in the radiator filler neck and that insures that any overflow of steam or hot liquid will be discharged through the overflow tube. An internal jacket around the main pressure spring is a distinctive feature of Avrea '822.

U.S. Pat. No. 4,185,751, issued to Moore et al. on Jan. 29, 1980 (Moore et al. −751) discloses a "Radiator Cap" comprising a first valve for admitting fluid into the radiator from the radiator overflow tank when the radiator is at atmospheric pressure. This valve remains open until fluid flow out of the radiator due to increased temperature and pressure during operation closes it. A second valve comprises an over pressure valve that releases fluid when the system becomes overheated.

U.S. Pat. No. 4,079,855, issued to Avrea on Mar. 21, 1978 (Avrea '855) discloses a "Monolithic Radiator Cap For Sealed Pressurized Cooling System" which is, for our purposes, virtually the same as the radiator cap disclosed in Avrea '822, discussed above. Avrea '855 and Avrea '822 originated from the same parent patent application, although each includes some material not found in the other.

U.S. Pat. No. 3,062,400, issued to Humbert on Nov. 6, 1962 (Humbert '400), discloses "Safety Valved Pressure Caps" comprising a manually operated pressure release valve that allows a person to relieve the pressure on an engine cooling system by actuating a lever on the exterior of the top surface of the cap. This cap includes an over pressure release valve and a smaller suction return valve, as do most modern radiator caps. The unique feature of this cap is the lever-handle on the exterior top surface of the cap, which provides a means for manually opening the pressure release valve, that is, the large valve that seats against the throat of the radiator. When the external lever is manually lifted, it tilts the pressure release valve upward, thereby allowing pressure to escape from the radiator. Using this cap, however, requires lifting the hood of the vehicle to reach the cap and then manually lifting the hot lever to release the pressure. Some hot liquid and gas can be expected to vent through the openings in the cap that are penetrated by the lever mechanism. This procedure is very awkward and unsafe for most people.

Each of the above references discloses a radiator cap having a valve for releasing excess cooling system pressure in a liquid cooled engine when the pressure of the fluid inside the radiator exceeds a predetermined level. Also disclosed in each of the references is a suction return valve for admitting fluid into the radiator from an overflow tank when the pressure inside the radiator drops as the engine and radiator cool. Also disclosed is a manually operated lever-actuated valve in a radiator cap for manually releasing the pressure in an engine cooling system.

Not shown in the references discussed above, however, is any mechanism for automatically releasing pressure from a cooling system as soon as the engine is turned off, that is, prior to any cooling. Nor do the references disclose any mechanism for maintaining the cooling system at atmospheric pressure from the time the engine is turned off until it is started again. In summary, the related art references do not disclose any automatic mechanism for quickly relieving unnecessary pressure from the cooling system, that is, as soon as the engine is turned off.

Therefore, there is a need for a device that automatically relieves all superatmospheric pressure from a vehicle cooling system when the engine is turned off and prevents any pressure from redeveloping as long as the engine is turned off. The present invention accomplishes this result and thereby significantly extends the life of cooling system components, such as hoses, and prevents accidental burns and scalds that could otherwise result from hot liquids being forced out of a radiator by the over pressure within the radiator.

SUMMARY OF THE INVENTION

Accordingly, it is a primary object of the present invention to provide an apparatus that extends the life of cooling system components in a liquid cooled engine, including, for example, the radiator, hoses, freeze plugs, and so forth.

It is another primary object of the present invention to provide an apparatus that greatly reduces the risk of injury from opening a hot radiator by insuring that the cooling system has no over pressure, or superatmospheric pressure, when the engine is turned off.

It is a further object of the present invention to provide a radiator cap that automatically releases accumulated pressure inside the cooling system of a liquid cooled engine when the engine is turned off.

It is a further object of the present invention to provide a radiator cap that automatically prevents any pressure from building up in the liquid cooling system of an engine when the engine is turned off.

It is a further object of the present invention to provide an embodiment of such a radiator cap that is operated by vacuum control from the ordinary engine manifold vacuum and another embodiment that is operated by electrical power.

It is a further object of the present invention to provide a radiator cap that will release any pressure on the cooling system of a liquid cooled engine whenever the driver chooses.

The present invention comprises a device for relieving the pressure from the cooling system of an internal combustion engine, such as a Diesel or gasoline engine, when the engine stops running.

Increasingly, automobile cooling systems are subject to failures such as ruptured hoses and radiators, or radiator tanks. The increased failure rate is attributable to the higher operating temperatures of these systems, which have been increased in order to increase engine efficiency, and to the use of plastic components in the radiators, notably the use of plastic radiator tanks.

When an engine is turned off, naturally the coolant no longer circulates within the radiator and water jacket, except perhaps for some minimal flow induced by convection. Therefore, when a hot engine is turned off the temperature and pressure within the cooling system actually rises, increasing substantially above the normal operating temperature and pressure—even those encountered under heavy duty operating conditions. This dramatically increased temperature and pressure damage the cooling system and significantly shorten the lives of the cooling system hoses and radiator.

The present invention provides a longer life for cooling system components by automatically releasing the over pressure on the cooling system to zero whenever the engine is turned off. The release of pressure on the cooling system begins the moment the engine is turned off or otherwise ceases running and the cooling system pressure is gradually bled off over a brief period lasting less than one minute.

In the preferred embodiment, the invention comprises a conventional radiator cap having an over pressure release valve and a suction return valve. A small hole is drilled vertically through the center of the top of the radiator cap, allowing a small push rod having a length of about 0.5–1.5 inches to penetrate the cap and almost contact the suction return valve at the bottom seal of the radiator cap. The reciprocal movement of the push rod is controlled by an energy source, either from the engine vacuum or the electrical system, which keeps the push rod in the up position (disengaged from the suction return valve) when the engine is running and in the down position (engaged with and thereby opening the suction return valve) when the engine is not running.

The push rod reciprocates vertically within a sleeve that maintains the push rod in a vertical orientation. If the push rod does not reciprocate vertically through the center of the radiator cap, it may cock the suction return valve to one side or the other and, in some circumstances, prevent the suction return valve from seating when the push rod is withdrawn. It is possible to redesign the suction return valve to prevent this effect, for example, by seating the suction return valve with a plurality of springs spaced apart adjacent to the outer perimeter of the suction return valve, but it has been found that this is not necessary and this additional expense and complexity can be avoided by carefully aligning the push rod and sleeve vertically in the center of the radiator cap.

The preferred embodiment further comprises a vacuum control, such as a vacuum advance module. This module in turn comprises an airtight housing, a conduit for attachment of a vacuum hose from the engine intake manifold, a compression spring that urges a lengthwise push rod downward, nd a diaphragm responsive to engine vacuum that keeps the push rod in a retracted position while the engine is running.

In operation, the pressure release device of the present invention replaces a conventional radiator cap and a source of engine vacuum is connected to it. While the engine is running, the push rod is held in the retracted position away from the suction return valve. When the engine is turned off, engine vacuum naturally is dissipated and the push rod is forced downward by the spring, where it opens the suction return valve enough to allow pressure in the system to escape, thereby simultaneously cooling the engine and relieving all pressure. The cap remains in an unsealed condition until the engine is restarted. Vapors that escape from the radiator by this operation of the device are conveyed to the coolant recovery tank in a wholly conventional manner, where they condense. Thus, no coolant is lost through use of the invention.

In an alternative embodiment, the push rod is held in the up position by an electrical solenoid that is energized whenever the engine is running. When the engine is turned off, the solenoid is de-energized, allowing a compression spring to push the push rod downward to open the suction return valve, as described above relative to the mechanical embodiment.

In either embodiment, it is preferable to seal the boundary between the push rod-actuator housing and the top of the radiator cap because minimal amounts of coolant may seep out of the radiator cap through the hole that the push rod is inserted through, which may be aesthetically displeasing to some drivers.

Other objects and advantages of the present invention will become apparent from the following description taken in connection with the accompanying drawings, wherein is set forth by way of illustration and example, the preferred embodiment of the present invention and the best mode currently known to the inventor for carrying out his invention.

DETAILED DESCRIPTION OF THE PREFERRED EMBODIMENTS

As required by the Patent Statutes and the case law, the preferred embodiment of the present invention and the best mode currently known to the inventors for carrying out their invention are disclosed in detail herein. The embodiments disclosed herein, however, are merely illustrative of the invention, which may be embodied in various forms. Therefore, specific structural and functional details disclosed herein are not to be interpreted as limiting, but merely to provide the proper basis for the claims and as a representative basis for teaching one skilled in the art to which the invention pertains to make and use the apparatus disclosed herein as embodied in any appropriately specific and detailed structure.

Figure 1:
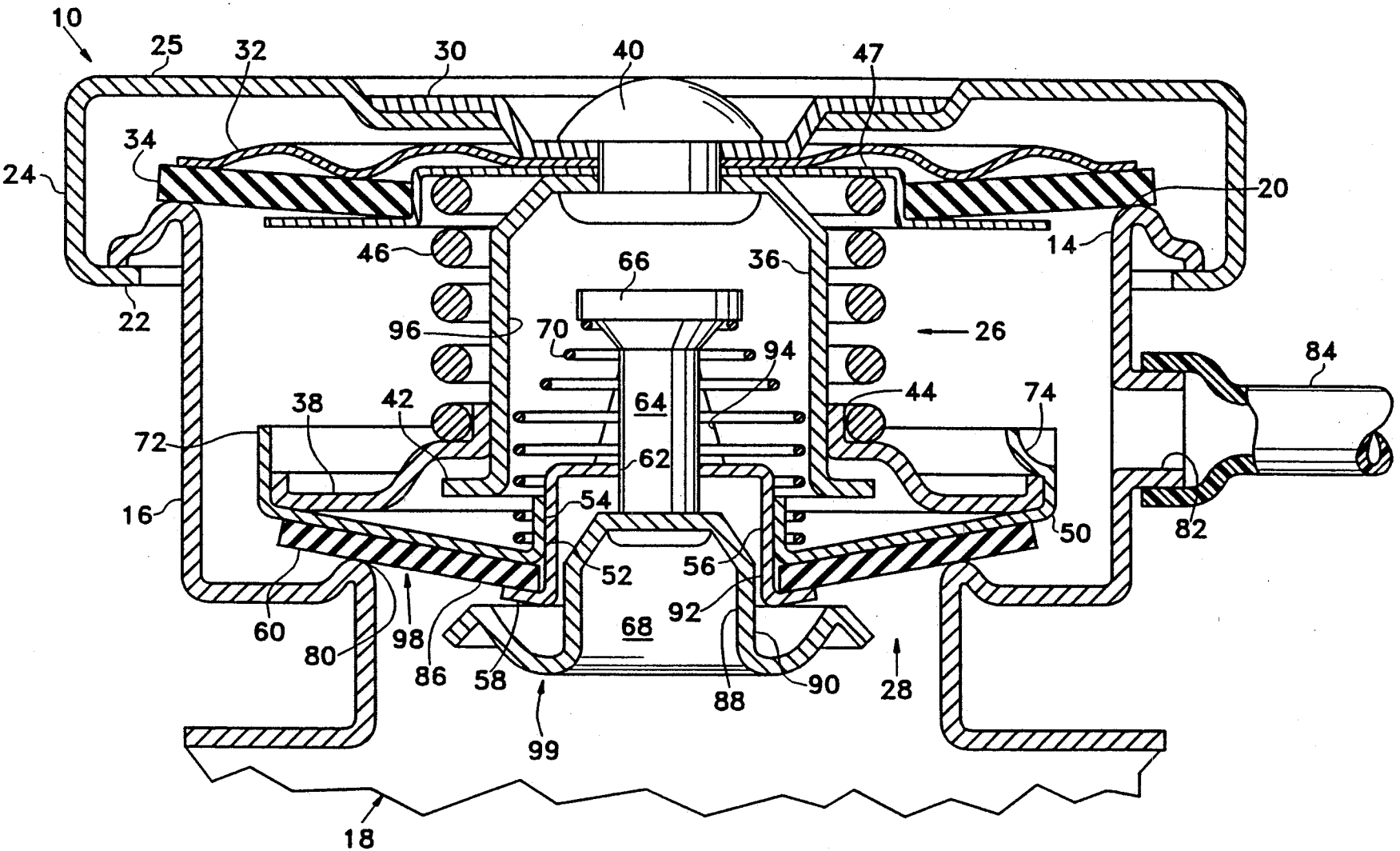
Fig. 1 (PRIOR ART)
FIG. 1 is sectional elevation of a prior art radiator cap.

Referring now to FIG. 1, PRIOR ART, there is shown a radiator cap 10, which closes an opening 14 provided by a neck 16 in a radiator 18, illustrated fragmentarily. The neck 16 of the radiator 18 provides an upper annular sealing lip 20 provided with the conventional camming surfaces and locking lands for engaging a pair of diametrically opposed locking ears 22 provided by a shell 24 of the radiator cap 10 at the very top of the radiator neck 16. The shell 24 includes a top surface 25.

The cap 10 maybe thought of as constructed from two sub-assemblies, a cap sub-assembly 26 and a bottom plate sub-assembly 28. The cap sub-assembly 26 includes the shell 25, a center plate 30, a spring-type diaphragm 32, a gasket 34, a hollow, inverted cup-shaped shank 36 and a retainer 38 in a vertical stack. The shell 24, the center plate 30, the diaphragm 32, the gasket 34 and the shank 36 are held together by a rivet 40. The shank 36 is provided with a radically outwardly extending flange 42 at its axially inner end to slidably capture the radially inner extent 44 of the retainer 38. A coiled compression spring 46 is captured on the shank 36 between a spring retainer 47 adjacent to the axially inwardly facing surface of the diaphragm 32 and the axially outwardly facing surface of the retainer 38 to urge the retainer 38 to its axially inner extent on the shank 36.

The bottom plate sub-assembly 28 includes a bottom plate 50 having a center opening 52 surrounded by an upstanding, axially outwardly projecting flange 54. A ferrule 56 is press-fitted into the center opening 52 and includes an axially inner flange 58. A flat annular gasket 60 is mounted on the bottom plate 50 and is held against it by the flange 58. The ferrule 56 includes a central opening 62. A pressure-vacuum vent valve stem 64 extends movably through the central opening 62 and is provided with a retainer 66 at its axially outer end and a cupuliform valve head 68 at its axially inner end. A coil spring 70 is captured on the valve stem 64 between the retainer 66 and the axially outer surface of ferrule 56.

The cap sub-assembly 26 and bottom plate sub-assembly 28 are joined to form the completed cap 10 assembly by crimping an axially outwardly projecting skirt 72 at the radially outer extent of bottom plate 50 radially inwardly at a plurality of crimping points 74, for example, three, about the perimeter of the skirt 72 radially inwardly beyond the radially outer extent of the retainer 38. The bottom plate sub-assembly 28 is thereby rotatably captured on the cap sub-assembly 26.

The neck 16 of the radiator 18 includes an axially outwardly facing seat 80 against which the gasket 60 normally rests when the cap 10 is in closing engagement with the neck opening 14. The neck 14 further includes an overflow port 82 positioned axially between the lip 20 and the seat 80, and connected by an overflow tube 84 to a coolant recovery bottle (not shown).

An over pressure release valve 98 comprises the gasket 60, the spring retainer 47, the coiled compression spring 46 and associated parts. The over pressure release valve 98 is sealed against the outwardly facing seat 80 of the neck 16 during all conditions except when the pressure inside the radiator 18 exerts enough force on the gasket 60 to overcome the force of the coiled compression spring 46, that is, primarily during significant expansion of the coolant, or boil over. The over pressure release valve 98 protects the engine and cooling system components against damage that might be caused by excessive pressure. It is closed in all other situations.

A suction return valve 99 comprises the cupuliform valve head 68, vacuum vent valve stem 64, the retainer 66, the coil spring 70 and associated parts. When the cooling system is in equilibrium operating condition, the normal pressure within the radiator 18 keeps the suction return valve closed, that is, the valve head 68 is seated against the underside of the gasket 60 of the over pressure release valve 98. When the engine and cooling system cool, the coolant volume decreases, causing a vacuum inside the cooling system that opens the suction return valve 99 by pushing it down, and thereby drawing coolant from the coolant recovery tank through the overflow tube 84 and the internal passages within the radiator cap 10, as described above.

In the position of the components shown in FIG. 1, the engine cooling system is in an operating equilibrium, and the steady-state positions of the various valve elements, when the engine cooling system pressure is between the lower and upper limits of its normal operating range. The increased pressure within the radiator, corresponding to a predetermined flow rate of coolant from within the radiator 18 axially outwardly between the valve seat 86 and the valve head 68 has force the valve heard 68 axially outwardly against the seat 86, closing the suction return valve 99. The pressure within the radiator 18, however, is not sufficient to raise the gasket 60 and the bottom plate 50 off the seat 80, that is, the over pressure release valve 98 also remains closed. Therefore, between the lower and upper operating pressure limits, the radiator 18 and associated cooling system comprise a closed, sealed system. When the coolant in the radiator 18 is between a first subatmospheric (low vacuum) pressure and a first superatmospheric pressure corresponding to the lower limit of the operating pressure range of the coolant within the radiator 18 and associated engine cooling system, the weight of the retainer 66, the valve stem 64 and the head 68 are sufficient to deflect the coil spring 70. In this position, the valve head 68 is away from its seat 86, which is provided by the underside of the gasket 60, and thus, the suction return valve 99 is open, while the over pressure release valve 98 remains closed. In a working cap, the spring deflection may be sufficient to produce, for example, a 0.060 inch (1.5 mm) clearance between the head 68 and the seat 86 with no flow. If the radiator 18 contents are then under pressure, they flow upwardly between the valve head 68 and the gasket 60, through an orifice 88 defined between the radially outer side wall 90 of the valve head 68 and the radially inner side wall 92 of the ferrule 56, through the ferrule 56 around its center opening 62, outwardly through an opening 94 provided in the side wall 96 of the shank 36, and through an overflow port 82 and the tube 84 to the coolant recovery bottle (not shown).

Figure 2:
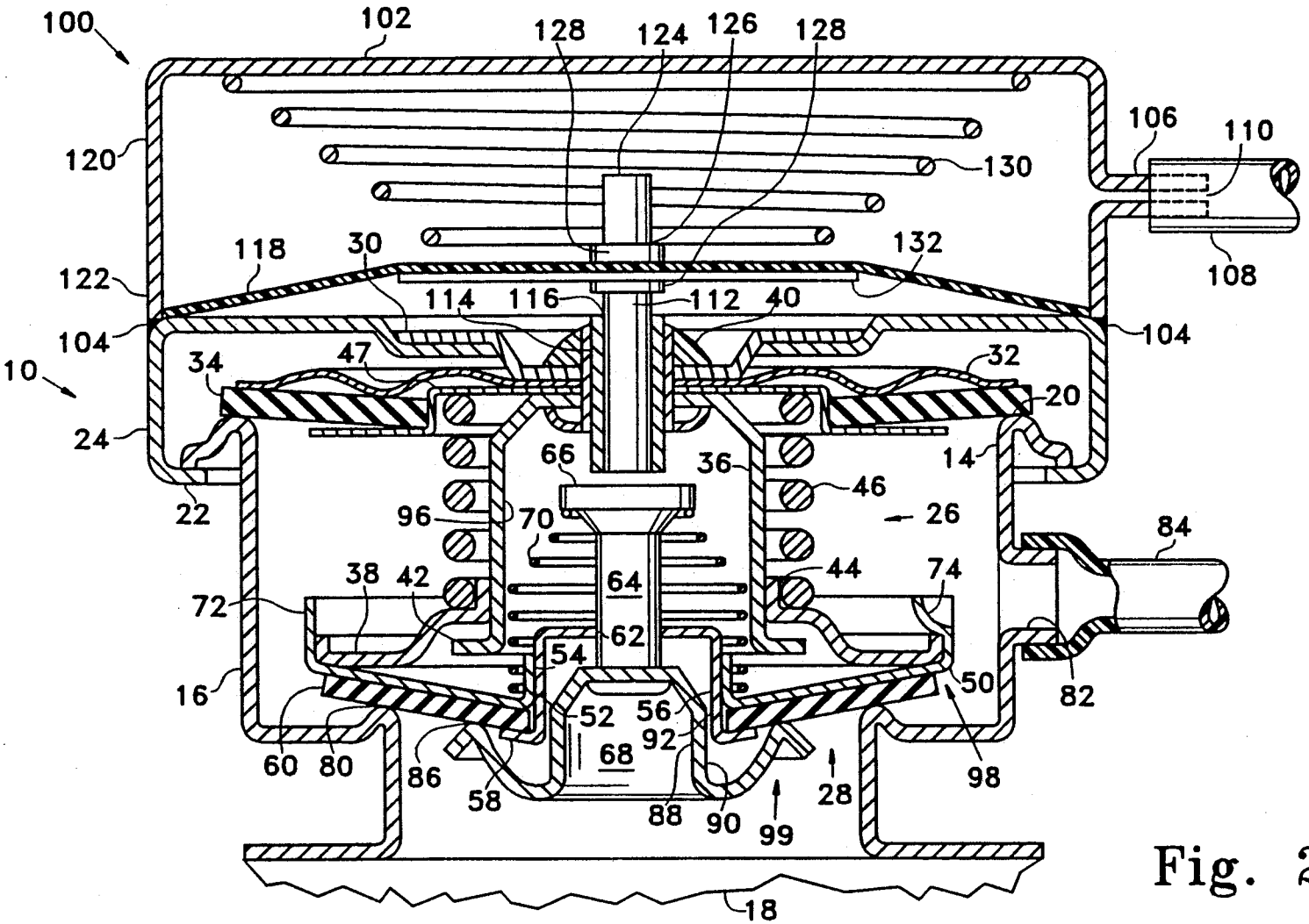
FIG. 2 is a sectional elevation of an automatic pressure release device for liquid cooled engines shown in the closed position illustrating a preferred embodiment that is controlled by the engine vacuum.

Referring now to FIG. 2, there is shown a preferred embodiment of an automatic pressure release device 100 according to the present invention comprising the radiator cap 10 discussed above and additional components for automatically opening the suction return valve whenever the engine is turned off. An airtight housing 102, which may be substantially cylindrical, is secured to the top of the radiator cap 10 about the perimeter of the shell 24 by the solder, razed, or weld bead 104. A vacuum port 106 is provided in one side of the housing and communicates through a vacuum tube 108 with the vacuum system of the engine, which naturally derives its vacuum power from the intake manifold, through the small orifice 110. Use of a small orifice provides more responsive operation of the device 100. A vertically oriented push rod 112 is inserted into a vertical sleeve 114 that is press fitted into an aperture 116 drilled through the rivet 40. A gas-impermeable flexible diaphragm 118 covers the surface area of the top of the radiator and is sealed about the interior perimeter of the housing 102 adjacent to the side wall 120 by a suitable adhesive so that the perimeter of the diaphragm 118 remains along the bottom 122 of the housing 102 during all phases of operation. The upper end 124 of the push rod 112 penetrates an aperture 126 in the diaphragm 118 and is secured by a retainer 128, thereby assuring that the push rod 112 and the diaphragm will move together and that the push rod 112 will remain connected to the diaphragm 118. A coiled compression spring 130 bears against the interior surface of the top of the housing 102 and against the upper surface of the diaphragm 118. The coiled compression spring 130 is wider at the top than at the bottom, that is, it has roughly conical shape. This shape prevents the coiled compression spring 130 from sliding around inside the housing 102. Thus, the coiled compression spring 130 is self-centering and needs no external mounting brackets or other restraints.

As shown in FIG. 2, the engine cooling system is in a normal equilibrium operating condition and the automatic pressure release device 100 closes and seals the radiator and cooling system. The over pressure release valve 98 is closed and the suction return valve 99 is closed. Further, the diaphragm 118 is drawn upward into the housing 102 by engine vacuum drawn through the vacuum tube 108, thereby drawing the push rod 112 upward and out of contact with the retainer 66. The negative pressure generated by engine vacuum varies widely depending on the throttle position, that is, engine vacuum drops dramatically during certain conditions, such as heavy acceleration of a vehicle. It has been found, however, that the suction return valve 99 will remain closed during all operation of the engine when the strength of the spring 130 and the length of the push rod 112 are properly selected. That is, even during heavy acceleration, the engine vacuum will be sufficient to overcome the downward bias of the spring 130 and the suction return valve 99 will therefore remain closed.

Figure 3:
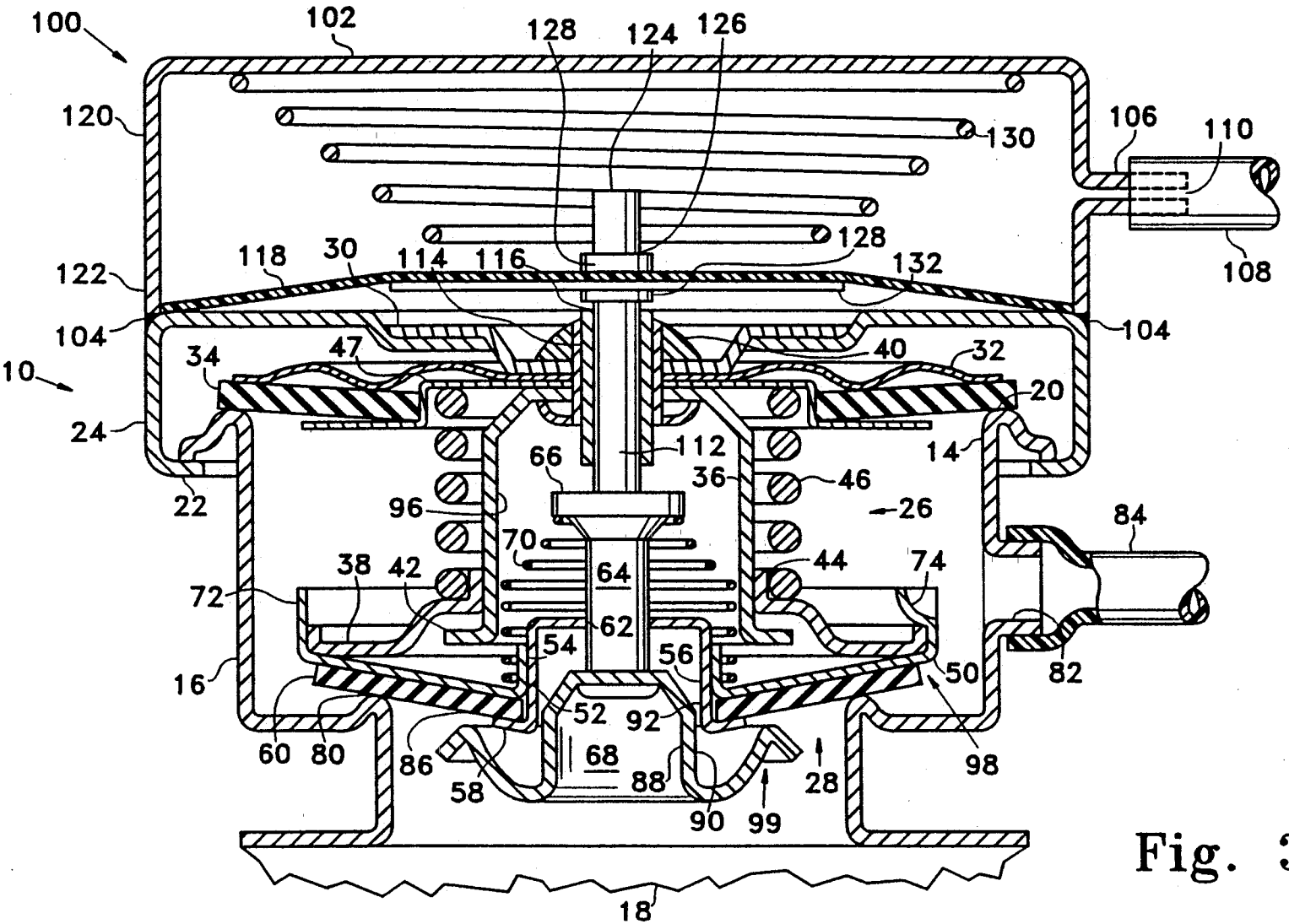
FIG. 3 illustrates the device of FIG. 2 shown in the open position.

Referring to FIG. 3, the automatic pressure release device 100 is shown with the parts in the equilibrium position when the engine is turned off. When the engine is turned off, the vacuum from the engine naturally dissipates through the engine cylinders, leaks and so forth, allowing the coiled compression spring 130 to push the diaphragm 118 down to the bottom of the housing 102 and thereby to push the push rod 112 down, where it contacts the retainer 66 and pushes the cupuliform valve 68 down and open, that is, the push rod 112 opens the suction return valve 99 by overcoming the force of the coil spring 70, allowing all over pressure, or superatmospheric pressure, to vent to the atmosphere through the passages within the radiator cap 10 described above, through the overflow tube 84 and through an air-bleed hole in the cap of the coolant recovery tank (not shown). When the coolant shrinks enough to produce a subatmospheric pressure within the cooling system, the automatic pressure release device 100 allows coolant to be drawn back into the cooling system through the suction return valve, just as a conventional radiator cap does. Because the suction return valve 99 remains open whenever the engine is not running, there is no opportunity for pressure to rebuild within the cooling system as might otherwise happen if the engine were hot and the suction return valve 99 were opened only for a short time after the engine was turned off.

As shown in FIG. 3, the automatic pressure release device 100 keeps the suction return valve 99 open whenever there is no engine vacuum, that is, when the engine is turned off, and keeps the suction return valve 99 whenever the engine is running.

The automatic pressure release device 100 can be easily installed by aftermarket users as a replacement for an ordinary radiator cap by tapping into any existing vacuum line or hose on the engine, such as the vacuum line running to the air cleaner on most new cars, with a T-junction and connecting a vacuum hose from the T-junction to the vacuum port 106 of the automatic pressure release device 100 and reconnecting the vacuum line to the air cleaner. Naturally, any conveniently located source of engine vacuum can be tapped to provide power for the automatic pressure release device 100.

Figure 4:
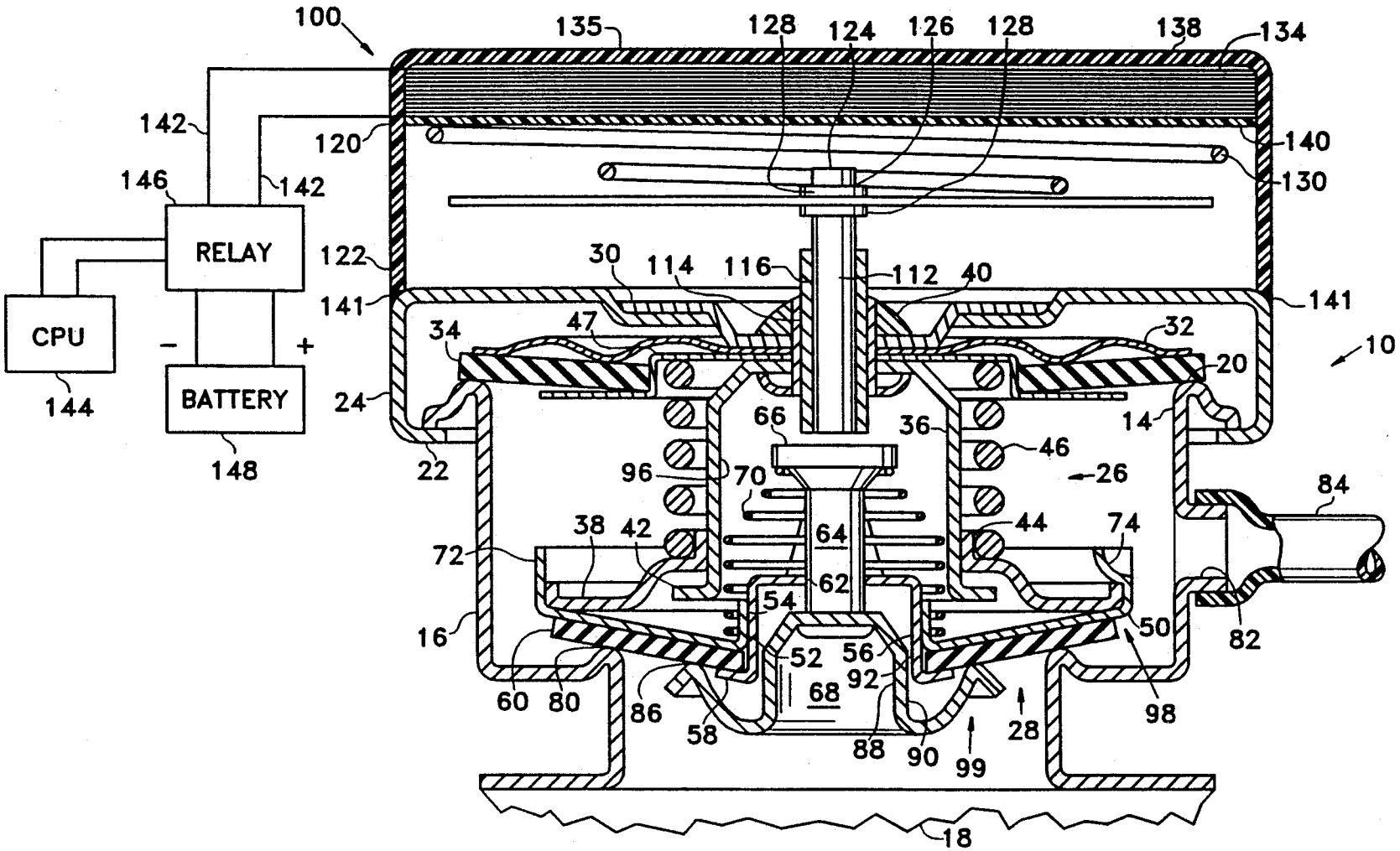
FIG. 4 is a sectional elevation of automatic pressure release device for liquid cooled engines similar to that shown in FIG. 2, but utilizing an electrical solenoid to release pressure from the system, illustrating the device in the closed position, along with connections to the engine computer.

Referring now to FIG. 4, there is shown an alternative embodiment of the present invention in which an electrical solenoid 134 secured to the inner surface of the top wall 135 of a plastic housing 138 by an adhesive is used to raise the push rod 112 and a compression spring 130 pushes the push rod down to open the suction return valve 99, as described above in relation to FIGS. 2, 3. The housing 138 is preferably made of plastic or other non-ferris material, for example, aluminum to provide a stronger magnetic field. The seam between the housing 138 and the radiator cap 10 is sealed with an epoxy bead 141 or the like. A plastic retainer plate 140 is secured by an adhesive or the like against the bottom of the solenoid 134 to prevent abrasion of the solenoid 134 by the spring 130.

As shown in FIG. 4, the suction return valve 99 is closed. The suction return valve opens in exactly the same manner as described above in relation to FIG. 3. Thus, the operation of the suction return valve 99 and the push rod 112 are the same in both embodiments disclosed herein.

Fixed to the upper end 124 of the push rod 112 by welding or the like is a ferris disk 135 having a diameter somewhat smaller that the diameter of the plastic housing 138.

Whenever the engine is running an electrical signal is transmitted from the engine's computer or CPU 144 to energize a relay 146, which in turn electrically connects a battery 148 to the electrical solenoid 134 through a pair of wires 142, 143, thereby generating a magnetic field around the solenoid 134. The magnetic field attracts the ferris disk 136, thereby pulling the push rod 112 up, which allows the suction return valve 99 to close. The solenoid remains energized so long as the engine is operating.

When the engine is turned off, the CPU 144 ceases signalling the relay 146 and the solenoid 134 is de-energized, allowing the spring 130 to push the push rod 112 down so that it engages and opens the suction return valve 99 and thereby de-pressurizes the cooling system. The suction return vale 99 then remains open until the engine is started again.

Alternatively, the push rod 112 may include an extension upward from the top or upper end 124 which would be drawn directly into an aperture within the center of the solenoid and the ferris disk 136 could be eliminated.

Other means for carrying out the objects of the present invention could be designed. For example, a vacuum controlled or electrically controlled device similar to those disclosed herein could be inserted into any of the radiator hoses or into a freeze plug opening, with an additional hose routed to the coolant recovery tank to collect and save coolant that could be expelled from the radiator during normal operation. In such embodiments, the suction return valve could be eliminated from the radiator cap. It has been found, however, that the preferred position for the apparatus disclosed in this specification is at or near the top of the cooling system, which is normally the location of the radiator cap, because this is where gases in the cooling system tend to accumulate and it is therefore thought that best position for the device is at the radiator cap.

Further, the electrically controlled embodiment, regardless of where it was located within the cooling system, could be wired into the engine control computer to release pressure from the cooling system on driver demand or when certain monitored engine operating parameters indicated the desirability of releasing pressure from the cooling system. Or, the vacuum operated embodiment could be connected to the driver's cockpit by a cable that would allow the driver to release engine pressure on demand.

While the present invention has been described in accordance with the preferred embodiments thereof, the description is for illustration only and should not be construed as limiting the scope of the invention. Various changes and modifications may be made by those skilled in the art without departing from the spirit and scope of the invention as defined by the following claims.

We claim:

1. An apparatus for automatically releasing the pressure in the cooling system of a liquid cooled engine in response to turning off the engine and preventing super-atmospheric pressure from rebuilding while the engine is not running, comprising:

a. a suction return valve in a radiator cap for seating in an element of the engine cooling system; and b. means for automatically opening said suction return valve in direct response to turning the engine off and keeping said suction return valve open while the engine is not running, thereby releasing the pressure on a cooling system of a liquid cooled engine when the engine is turned off, said suction valve opening means being directly responsive to an off state of the engine and automatically releasing super-atmospheric pressure on said cooling system in response to an engine off condition, said suction return valve opening means further comprising a push rod mounted for reciprocal vertical movement within said radiator cap for engaging and opening said suction return valve when said engine is turned off and keeping said suction return valve open while said engine remains off.

2. An apparatus according to claim 1 wherein said automatic suction valve opening means further comprises a vacuum controlled means responsive to a state of engine vacuum, whereby an absence of said engine vacuum causes said suction valve opening means to release super-atmospheric pressure from the cooling system and prevents pressure from rebuilding while the engine is off.

3. An apparatus according to claim 1 wherein said suction return valve opening means further comprises an electrically controlled means for reciprocating said push rod, said electrically controlled means being responsive to certain electrical signals representative of an engine on or off conditions produced by a CPU operatively connected to the engine, whereby said suction return valve is open whenever the engine is not on and is closed whenever the engine is on.

4. An apparatus for automatically releasing the pressure developed in the cooling system of a liquid cooled engine under normal engine operation, which defines a "on" state, said pressure being released when the engine is turned off and while the engine is not running, which defines an "off" state, comprising:

a. a radiator cap, said radiator cap further comprising a shell having a top surface, an over pressure release valve for engaging an outwardly facing seat of a radiator neck of a radiator and a suction return valve; and b. means for automatically opening said suction return valve when the engine is turned off, said suction return valve automatically opening in response to an engine off state and automatically closing in response to an engine on state, said suction return valve opening means further comprising a push rod mounted for reciprocal vertical movement within said radiator cap for engaging and opening said suction return valve.

5. An apparatus according to claim 4 further comprising means for maintaining said suction return valve in said open position while the engine is turned off.

6. An apparatus according to claim 4 wherein said automatic opening means further comprises a vacuum controlled means, said vacuum controlled means being operatively connected to an intake manifold vacuum system of the engine for causing said suction return valve to open in the absence of engine vacuum.

7. An apparatus according to claim 4 wherein said automatic opening means further comprises an electrically controlled means for reciprocating said push rod, said electrically controlled means being responsive to certain electrical signals representative of an engine on or off conditions produced by a CPU operatively connected to the engine, whereby said suction return valve is open whenever the engine is not on and is closed whenever the engine is on.

8. An apparatus according to claim 7 wherein said electrical control means further comprises an electrical solenoid operatively connected to said push rod for controlled reciprocal movement of said push rod, which opens said suction return valve by pushing downward on said suction return valve and allows said suction return valve to close withdrawing from contact with said suction return valve.

9. An apparatus according to claim 4 further comprising:

a. a housing seated on said top surface of said shell of said radiator cap, said housing having an inner perimeter and at least one side wall and a top wall;

b. said push rod vertically aligned for reciprocal movement within a sleeve seated in the top of said shell of said radiator cap;

c. a diaphragm having a perimeter coextensive with said inner perimeter of said housing and fixed to a lower portion of said at least one side wall of said housing about said perimeter of said diaphragm, said diaphragm located above said push rod, and means for connecting said push rod to said diaphragm, whereby said push rod reciprocates within said sleeve in response to movement of said diaphragm;

d. spring means retained within said housing between said top wall and said diaphragm for biasing said diaphragm and said push rod downward to contact and open said suction return valve, whereby said suction return valve is opened in the absence of engine vacuum that draws said diaphragm and said push rod up and lifts said push rod above said suction return valve, allowing said suction return valve to close, in the presence of engine vacuum; and e. means for connecting said housing to an intake manifold vacuum system of the engine for actuating said diaphragm.

10. An apparatus according to claim 9 wherein said connecting means further comprises an aperture in said diaphragm through which said push rod is inserted and a first retainer seated on said push rod above said diaphragm and a second retainer seated on said push rod below said diaphragm, whereby said diaphragm and said push rod are fixedly connected for joint up and down movement in response to forces exerted on said diaphragm, whereby said push rod reciprocates within said sleeve.

11. An apparatus according to claim 10 further comprising a washer plate seated between said first and second retainers.

12. An apparatus according to claim 9 wherein said spring means further comprises a coiled compression spring within said housing and bearing against an upper interior surface of said housing and against an upper surface of said diaphragm, said coiled compression spring urging said push rod downward.

13. An apparatus for automatically releasing the pressure in the cooling system of a liquid cooled engine in direct response to turning the engine off and while the engine remains off, comprising:

a. a radiator cap, said radiator cap further comprising a shell having a top surface, an over pressure release valve for engaging an outwardly facing seat of a radiator neck of a radiator and a suction return valve, with both said valves connected to said shell; and b. vacuum controlled means for automatically opening said suction return valve when the engine is turned off in direct response to turning the engine off, said vacuum controlled means further comprising a housing seated on said top surface of said shell of said radiator cap, said housing having an inner perimeter and at least one side wall and a top wall, a push rod vertically aligned for reciprocal movement within a sleeve seated inside said radiator cap, a diaphragm having a perimeter, said perimeter being coextensive with said inner perimeter of said housing and fixed to said at least one side wall of said housing about said diaphragm perimeter, said diaphragm located above said push rod, whereby said push rod reciprocates within said sleeve in response to an up and down movement of said diaphragm, and spring means retained within said housing above said diaphragm and biasing said diaphragm and said push rod downward to contact and open said suction return valve, whereby said suction return valve is opened by said push rod in the absence of engine vacuum and said push rod is lifted above said suction return valve, allowing said suction return valve to close, in the presence of engine vacuum.

14. An apparatus according to claim 13 wherein said spring means further comprises a coiled compression spring within said housing and bearing against said top wall of said housing and against said diaphragm, said coiled compression spring urging said push rod downward, whereby in a vacuum absent state, said push rod pushes said suction return valve open and maintains said suction return valve in an open position until engine vacuum draws said diaphragm upward, thereby drawing said push rod up and out of contact with said suction return valve, whereby said suction return valve closes.

15. An apparatus for automatically releasing the pressure in the cooling system of a liquid cooled engine in response to turning off the engine and preventing superatmospheric pressure from rebuilding while the engine remains off, comprising:

a. a radiator cap, said radiator cap further comprising a shell having a top surface, an over pressure release valve for engaging an outwardly facing seat of a radiator neck of a radiator and a suction return valve, with both said valves connected to said shell; and b. electrically controlled means for automatically opening said suction return valve as the engine is turned off and keeping said suction control valve open while the engine remains off, said electrically controlled means further comprising, a housing seated on said top surface of said shell of said radiator cap, said housing having an inner perimeter and at least one side wall and a top wall, a push rod vertically aligned for reciprocal movement within a sleeve seated inside said radiator cap, an electrical solenoid seated within said housing and operatively connected to an engine CPU source of electrical signals responsive to an engine on state and an engine off state, whereby said solenoid is energized when said engine is on, thereby drawing said push rod up and allowing said suction return valve to close and is de-energized when said engine is off; and c. spring means retained within said housing and biasing said push rod downward, whereby said spring urges said push rod into contact with and opens said suction return valve when said solenoid is de-energized.

16. An apparatus according to claim 15 wherein said solenoid further comprises a ferris disk fixed to said push rod and perpendicular thereto.

17. An apparatus according to claim 15 wherein said electrically controlled means further comprises and means for triggering an electrical relay said electrical relay in response to electrical signals from said CPU, representative of said on or off state of said engine, said relay being operatively connected to deliver electrical power to said solenoid while the engine is on.

18. An apparatus according to claim 15 wherein said radiator cap further comprises a top having a center and a rivet in said center of said top of said radiator cap and an aperture through said rivet in which said sleeve is seated.

* * * * *